US010008095B2

(12) United States Patent
Reyes-Rodriguez et al.

(10) Patent No.: US 10,008,095 B2
(45) Date of Patent: Jun. 26, 2018

(54) SYSTEMS AND METHODS FOR PRESENCE MONITORING OF A GROUND-ENGAGING TOOL RELATIVE TO A MACHINE

(71) Applicant: Caterpillar Inc., Peoria, IL (US)

(72) Inventors: Solimar Reyes-Rodriguez, Edwards, IL (US); Maria Cristina Herrera De Kontz, Chillicothe, IL (US); Aloke Jude Mascarenhas, Peoria, IL (US)

(73) Assignee: Caterpillar Inc., Deerfield, IL (US)

( * ) Notice: Subject to any disclaimer, the term of this patent is extended or adjusted under 35 U.S.C. 154(b) by 24 days.

(21) Appl. No.: 15/226,560

(22) Filed: Aug. 2, 2016

(65) Prior Publication Data

US 2018/0040228 A1 Feb. 8, 2018

(51) Int. Cl.
*G08B 21/18* (2006.01)

(52) U.S. Cl.
CPC ..... *G08B 21/187* (2013.01)

(58) Field of Classification Search
CPC ..... G08B 21/187; G08B 21/18
USPC ..... 340/680
See application file for complete search history.

(56) References Cited

U.S. PATENT DOCUMENTS 6,990,390 B2 * 1/2006 Groth ..... E02F 3/435 37/413
8,890,672 B2 * 11/2014 Miller ..... H04Q 9/00 340/10.1
2004/0227645 A1 11/2004 Lujan
2010/0096148 A1 * 4/2010 Chiorean ..... E02F 9/2095 172/430
2015/0149049 A1 5/2015 Bewley et al.
2015/0337522 A1 11/2015 Diekevers et al.

FOREIGN PATENT DOCUMENTS

WO 2012107848 A1 8/2012
WO 2012116408 A1 9/2012
WO 2013033164 A1 3/2013
WO 2014026742 A1 2/2014

OTHER PUBLICATIONS

"Monitoring Operational Mining Equipment Using Sprouts Wireless Sensor Network Platform", Ahmad El Kouche, Abdallah Alma'aitah, Hossam Hassanein, School of Computing, Queen's University, Kingston, Ontario, Canada.

* cited by examiner

*Primary Examiner* — Qutbuddin Ghulamali
(74) *Attorney, Agent, or Firm* — Miller, Matthias & Hull

(57) ABSTRACT

A system for monitoring presence of a ground-engaging tool relative to a machine, on a worksite, is disclosed. The system includes a sensor operatively coupled to the ground-engaging tool, a signal receiver, and a controller. The sensor is configured to transmit an identifying wireless signal. The controller is configured to receive a received signal from the signal receiver; the received signal based on the identifying wireless signal and having a signal power. The controller is configured to determine a signal attenuation power of the received signal, based on the signal power relative to the transmission power, determine a relative location of the ground-engaging tool and one or more fault conditions based on the signal attenuation power, and determine if the ground-engaging tool is connected to the machine based on the relative location of the ground-engaging tool and the existence of one or more fault conditions.

16 Claims, 8 Drawing Sheets

SYSTEMS AND METHODS FOR PRESENCE MONITORING OF A GROUND-ENGAGING TOOL RELATIVE TO A MACHINE

TECHNICAL FIELD

The present disclosure generally relates to presence monitoring systems for machine components and, more particularly, to presence monitoring systems configured to determine presence of a ground-engaging tool, relative to the machine.

BACKGROUND

Work machines, such as excavators and tele-handlers, are often used to control an implement, such as a bucket, to perform a given task at a construction and/or mining worksite. For example, such implements may be used for a variety of tasks in which the implement engages with the ground. These tasks may include digging, hauling, excavating, or any other task in which the implement, or an associated component, engages the ground. Accordingly, such implements often include, or are coupled with, ground-engaging tools. Ground-engaging tools may be utilized to protect the implement from undue wear and/or to perform additional, ground-engaging functions.

For example, a bucket operatively associated with a machine (e.g., an excavator) may include a plurality of ground-engaging tools that are affixed to the bucket such as, but not limited to, teeth, shrouds, adapters, and the like. Because such ground-engaging tools may be exposed to greater contact and friction than the bucket itself, ground-engaging tools are typically removable from the bucket and may be replaced multiple times over the course of the life of the machine and/or bucket.

However, because ground-engaging tools may be removable, during operation of the machine, the ground-engaging tools may accidentally disengage from the bucket. Disengaged ground-engaging tools may cause a variety of worksite issues, such as, but not limited to, decreased productivity and excessive wear on other, bucket-attached ground-engaging tools. Further, loose ground-engaging tools on the worksite may cause damage to downstream, operating machines. For example, if a disengaged ground-engaging tool lands in a load of materials, which is then hauled to a crusher, the disengaged ground-engaging tool may enter the crusher with the load of materials. If a ground-engaging tool is caught in a crusher, the tool may cause a jam or otherwise damage the crusher, which can lead to time-consuming repairs and/or a loss of productivity.

In some example systems for monitoring components of implements of machines, sensors are used to detect or confirm presence of such components, relative to the implement and/or the machine. For example, the systems and methods of U.S. Patent Application Publication No. 2015/0149049 ("Wear Part Monitoring") utilize a visual sensor affixed to the bucket of an excavator to visualize the location of a wear part and determine if it is missing from the implement.

However, while the systems of the '049 application may, generally, determine presence relative to the bucket, they do not address proximity of a fallen part, relative to the machine and/or bucket, upon falling from the bucket, nor do the systems account for location-based faults associated with position of the disengaged tool. Therefore, improved presence monitoring systems configured to determine presence of a ground-engaging tool, relative to the machine, are desired.

SUMMARY

In accordance with one aspect of the disclosure, a system for monitoring presence of a ground-engaging tool relative to a machine, on a worksite, is disclosed. The system may include a sensor operatively coupled to the ground-engaging tool, a first signal receiver at a first location proximate to the machine, and a controller, which includes a processor. The sensor may be configured to transmit an identifying wireless signal, the identifying wireless signal recognizable as being associated with the ground-engaging tool and having a transmission power upon transmission. The first signal receiver may be configured to detect and receive wireless signals from the sensor. The controller may be configured to receive a first received signal from the first signal receiver; the first received signal based on the identifying wireless signal, recognizable as being associated with the ground-engaging tool, and having a first signal power. The controller may further be configured to determine a first signal attenuation power of the first received signal based on the first signal power relative to the transmission power and determine a relative location of the ground-engaging tool, relative to the machine, based on the first signal attenuation power. The controller may further be configured to determine existence of one or more fault conditions associated with the ground-engaging tool based on the first signal attenuation power and determine if the ground-engaging tool is connected to the machine based on the relative location of the ground-engaging tool and the existence of one or more fault conditions.

In accordance with another aspect of the disclosure, a method for monitoring positioning of a ground-engaging tool, relative to a machine on a worksite, is disclosed. The method may include receiving information associated with an identifying wireless signal, the identifying wireless signal transmitted by a sensor operatively coupled to the ground-engaging tool and recognizable as being associated with the ground-engaging tool, the information associated with the wireless signal including a transmission power of the identifying wireless signal. The method may further include receiving a first received signal at a first location, the first received signal based on the identifying wireless signal, recognizable as being associated with the ground-engaging tool, and having a first signal power. The method may further include determining a first signal attenuation power of the first received signal based on the first signal power relative to the transmission power and determining a relative location of the ground-engaging tool, relative to the machine, based on the first signal attenuation power. The method may further include determining existence of one or more fault conditions associated with the ground-engaging tool, based on the first signal attenuation power, and determining if the ground-engaging tool is connected to the machine based on the relative location of the ground-engaging tool and the existence of one or more faults.

In accordance with yet another aspect of the disclosure, a machine is disclosed. The machine may include a machine body, a crane operatively associated with the machine body, an implement operatively associated with the crane, and a ground-engaging tool connective with the implement. The machine may further include a sensor operatively coupled to the ground-engaging tool, a first signal receiver at a first location proximate to the machine, and a controller, which includes a processor. The sensor may be configured to transmit an identifying wireless signal, the identifying wireless signal recognizable as being associated with the ground-engaging tool and having a transmission power upon transmission. The first signal receiver may be configured to detect and receive wireless signals from the sensor. The controller may be configured to receive a first received signal from the first signal receiver; the first received signal based on the identifying wireless signal, recognizable as being associated with the ground-engaging tool, and having a first signal power. The controller may further be configured to determine a first signal attenuation power of the first received signal based on the first signal power relative to the transmission power and determine a relative location of the ground-engaging tool, relative to the machine, based on the first signal attenuation power. The controller may further be configured to determine existence of one or more fault conditions associated with the ground-engaging tool based on the first signal attenuation power and determine if the ground-engaging tool is connected to the machine based on the relative location of the ground-engaging tool and the existence of one or more fault conditions.

These and other aspects and features of the present disclosure will be better understood when read in conjunction with the accompanying drawings.

While the following detailed description will be given with respect to certain illustrative embodiments, it should be understood that the drawings are not necessarily to scale and the disclosed embodiments are sometimes illustrated diagrammatically and in partial views. In addition, in certain instances, details which are not necessary for an understanding of the disclosed subject matter or which render other details too difficult to perceive may have been omitted. It should therefore be understood that this disclosure is not limited to the particular embodiments disclosed and illustrated herein, but rather to a fair reading of the entire disclosure and claims, as well as any equivalents thereto.

DETAILED DESCRIPTION

Figure 1:
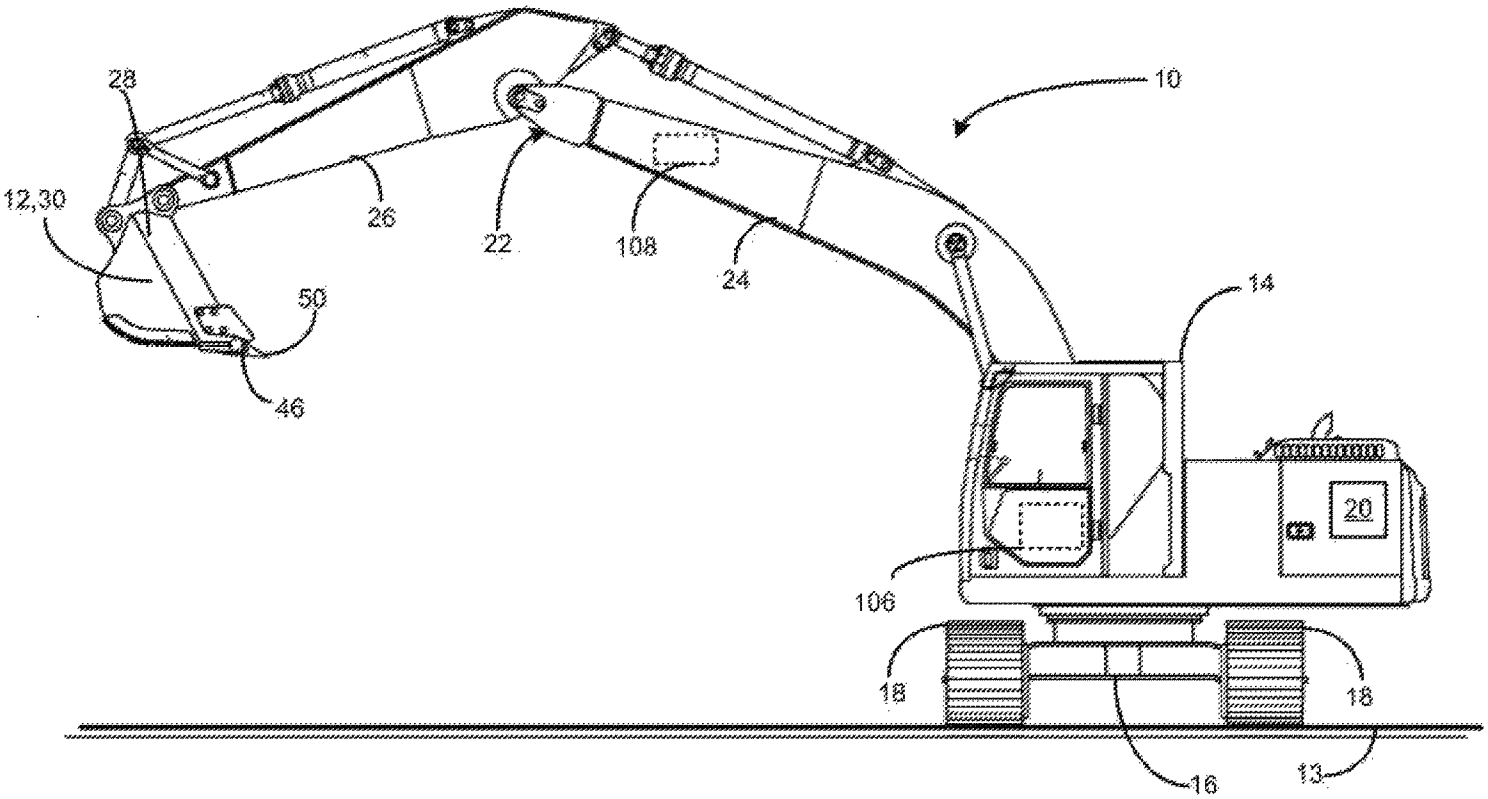
FIG. 1 is a side view of an example machine and elements of an example system for monitoring presence of one or more ground-engaging tools, in accordance with an embodiment of the present disclosure.

Turning now to the drawings and with specific reference to FIG. 1, a machine 10, utilizing an implement 12, is illustrated in accordance with the teachings of the present disclosure. While the machine 10 in FIG. 1 is depicted, generally, as an excavator-type machine, the teachings of the present disclosure may relate to other work machines that employ an implement associated with said machine. The term "machine" as used herein may refer to any machine that performs some type of operation associated with an industry such as construction, mining, farming, transportation, or any other industry known in the art. For example, the machine 10 may be a construction machine, such as a wheel loader, excavator, dump truck, backhoe, motor grader, material handler, tele-handler, or the like. Moreover, the implement 12 connected to the machine may be utilized for a variety of tasks including, but not limited to hauling, construction, loading, compacting, lifting, brushing and may include, for example, buckets, extruders, compactors, forked lifting devices, brushes, grapplers, cutters, shears, blades, breakers, hammers, augers, and the like. The machine 10 and implement 12 operate, in conjunction, to perform tasks on a worksite 13.

As depicted in FIG. 1, the machine 10 may include a housing 14 disposed on top of and supported by an undercarriage 16. The undercarriage 16 may be associated with one or more ground engaging devices 18, which may be used for mobility and propulsion of the machine 10. The ground engaging devices 18 are shown as a pair of continuous tracks; however, the ground engaging devices 18 are not limited to being continuous tracks and may additionally or alternatively include other ground engaging devices such as rotatable wheels. A power system 20 may provide power to the propel or otherwise move the ground engaging devices 18 and may include one or more power sources, such as internal combustion engines, electric motors, fuel cells, batteries, ultra-capacitors, electric generators, and/or any power source which would be known by a person having ordinary skill in the art. Such a power system 20 may further be used to power various motions of the implement 12 or any other elements and control systems associated with the machine 10 and/or implement 12.

For controlling movements the implement 12, the machine 10 may further include a crane 22, which may include a boom 24 operatively coupled with a stick 26. The implement 12 may be attached to the crane 22 at, for example, a distal end 28 of the stick 26. In some examples, positioning of the implement 12, the crane 22 and, as associated elements, the boom 24 and stick 26, may be controlled by a control system (not shown).

Figure 2:
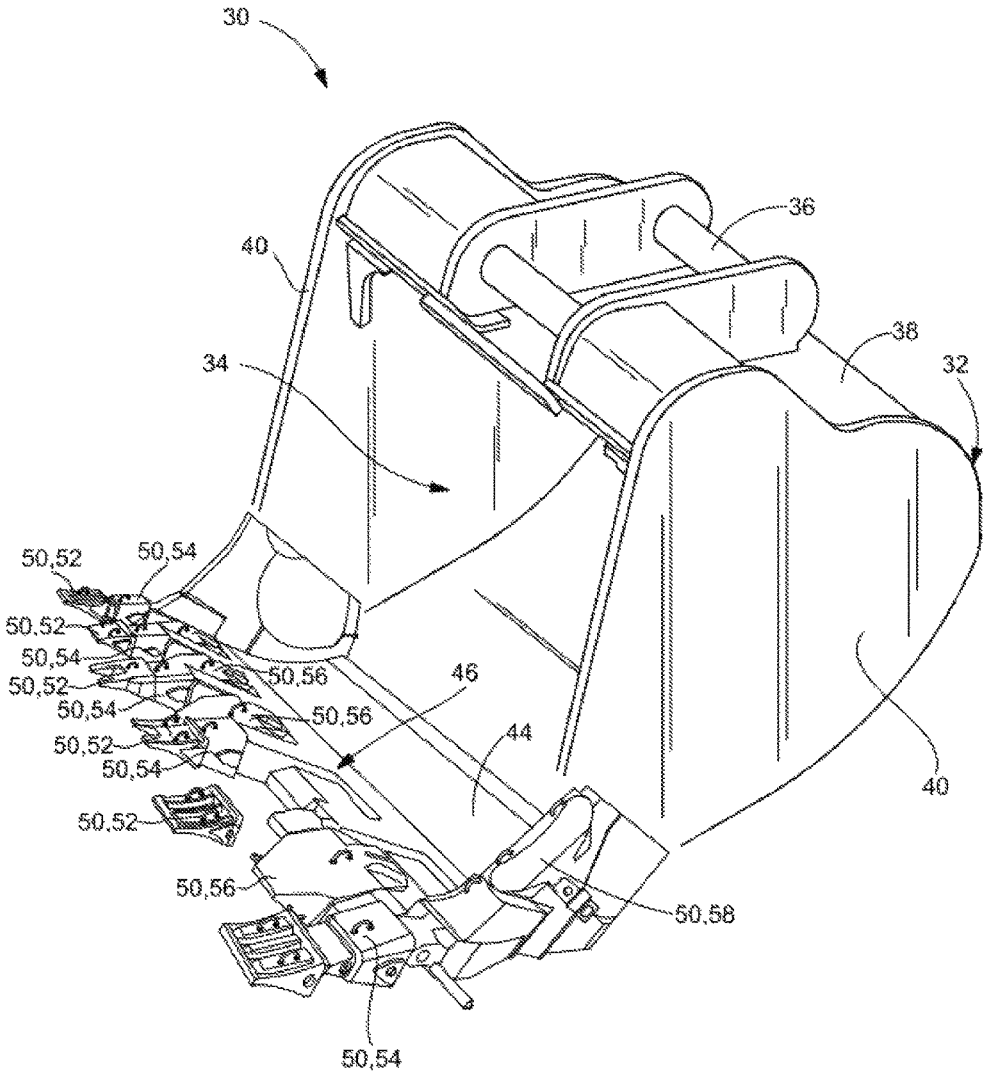
FIG. 2 is a perspective view of an example implement used in conjunction with the machine of FIG. 1, the implement having one or more ground-engaging tools associated therewith, in accordance with the present disclosure and FIG. 1.

In some examples, such as the illustrated embodiment, the implement 12 may be a bucket 30, which is shown in greater detail in FIG. 2. The bucket 30 may include a shell 32, which defines a cavity 34, in which materials may be carried during any material movement operations. In some examples, the bucket 30 may include a linkage 36, at which the bucket 30 may be connected to the crane 22, via, for example, the stick 26 of the crane 22. The linkage 36 may be formed or otherwise constructed atop a top wall 38 of the shell 32 of the bucket 30. Further, the shell 32 may include opposing side walls 40 and a back wall 42. At a forward end 44 of the back wall 42, the bucket 30 includes a lip 46. It is to be appreciated that the specific geometry, defined shape elements, and/or structure of the bucket 30 shown in FIG. 2 is non-limiting and the systems, methods, and machines disclosed herein are certainly applicable to systems, methods, and machines which employ buckets and/or implements having alternative geometry, defined shape elements, and/or structure than that of the bucket 30, illustrated in FIG. 2.

The lip 46 may be configured as a digging and/or ground engaging portion of the bucket 30. Accordingly, the lip 46 may be the portion of the bucket 30 which leads contact with ground on a worksite, such as the worksite 13 of FIG. 1. To protect the bucket 30 and, in some examples, the lip 46, the bucket 30 may include, or be otherwise connectively associated with, one or more ground-engaging tools 50. The ground-engaging tools 50 may be utilized to protect the bucket 30 from undue wear and/or to perform additional, ground-engaging functions, such as breaking up ground on the worksite 13 in advance of the lip 46 making contact with the worksite 13. In some examples, the ground-engaging tools 50 may include, but are not limited to including, teeth 52, tooth adapters 54, lip shrouds 56, wing shrouds 58, and any other ground-engaging tools 50 known in the art. Because such ground-engaging tools 50 may be exposed to greater contact and friction than the bucket 30, itself, is exposed to, the ground-engaging tools 50 may be connectable and removable from the bucket 30.

Figure 3:
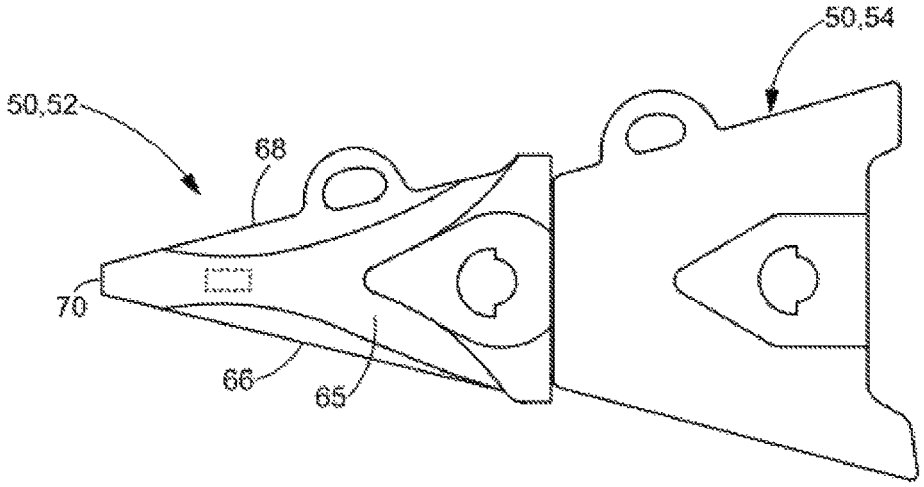
FIG. 3 is a side view of a tooth and associated adapter of the ground-engaging tools of FIG. 2, in accordance with the present disclosure and FIG. 2.
Figure 4:
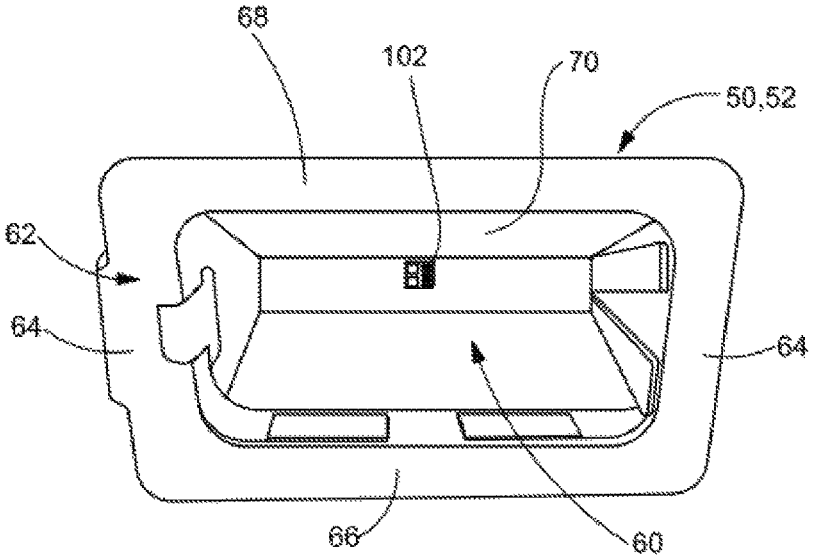
FIG. 4 is a rear view of the tooth of FIG. 3, illustrating an inner cavity of the tooth, in accordance with the present disclosure.

An example of one of the ground-engaging tools 50, more specifically one of the teeth 52, is illustrated in greater detail in FIGS. 3 and 4. FIG. 3 illustrates the tooth 52 in a side view and in connection with one of the tooth adapters 54. The tooth 52 may be connectively associated with the bucket 30 via the tooth adapter 54, however, it is certainly not limited to being connectively associated with the bucket 30 via the tooth adapter 54. For example, the tooth 52 may be directly connected to the lip 46 of the bucket 30 via any connective geometry of the lip 46 and/or any connective device associated with one or both of the lip 46 and the tooth 52. As shown best in FIG. 4, the tooth 52 may include an inner cavity 60, which is defined by a tooth shell 62 of the tooth 52. The tooth shell 62 may further define side walls 64, a bottom wall 66, a top wall 68, and an end wall 70. The inner cavity 60 may be configured to accept a connective element from the lip 46 and/or another ground-engaging tool 50, such as, but not limited to, the tooth adapter 54. It is to be appreciated that the specific geometry, defined shape elements, and/or structure of the tooth 52, the tooth adapter 54, and/or any ground-engaging tool 50 shown in FIGS. 3 and 4 are non-limiting and the systems, methods, and machines disclosed herein are certainly applicable to systems, methods, and machines which employ ground-engaging tools and/or wear parts having alternative geometry, defined shape elements, and/or structure than that of the tooth 52, the tooth adapter 54, and/or any ground-engaging tool 50 shown in FIGS. 3 and 4.

Figure 5:
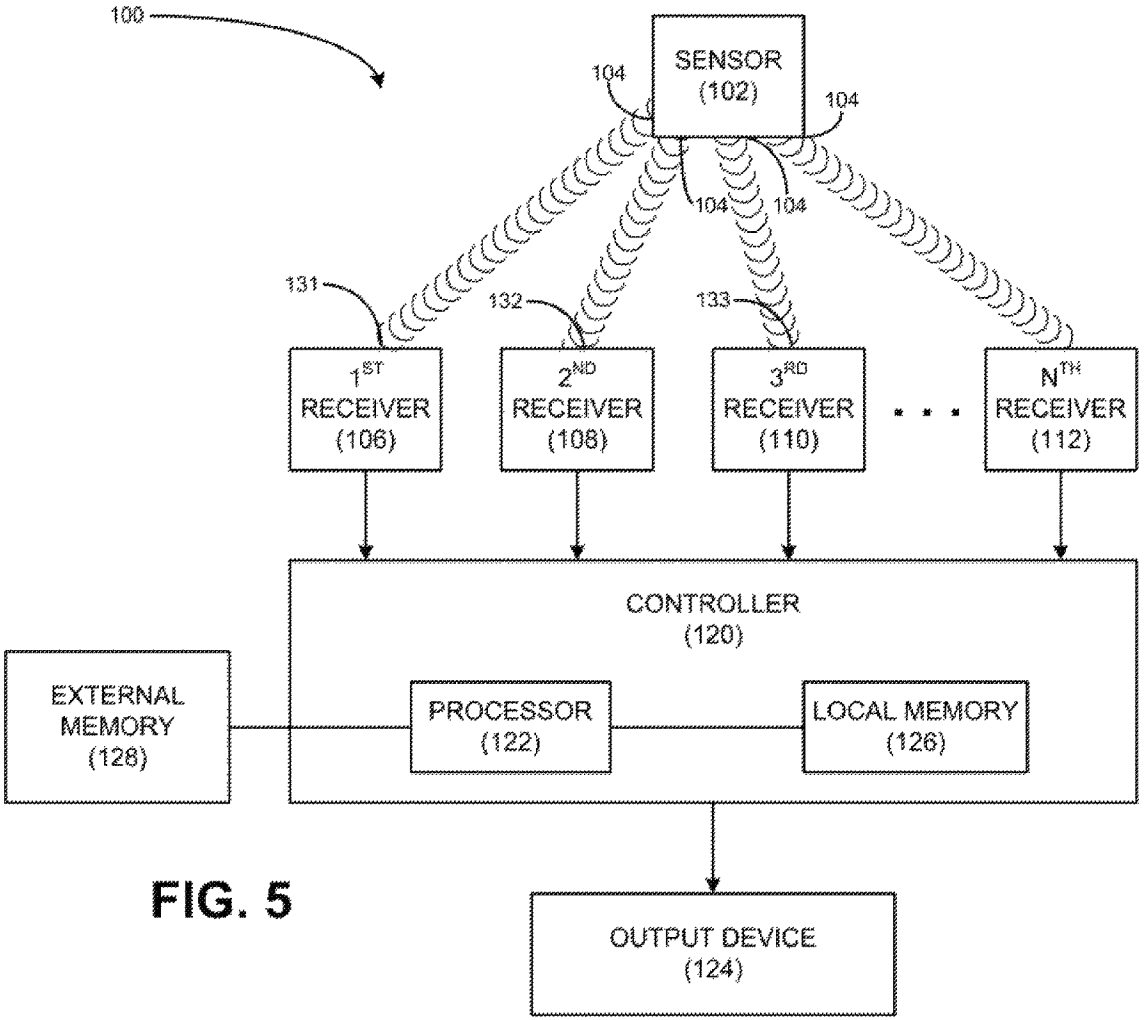
FIG. 5 is a schematic block diagram of the example system for monitoring presence of one or more ground-engaging tools associated with a machine, in accordance with an embodiment of the disclosure and FIGS. 1-4.

Because the ground-engaging tools 50 may be connectable and removable from the bucket 30, the ground-engaging tools 50 may accidentally disengage from the bucket 30 during operation of the machine 10. A disengaged ground-engaging tool 50 may cause harm to downstream machines on the worksite 13 and/or may lead to decreases in productivity, as discussed above. Accordingly, a system 100, for monitoring presence of one or more of the ground-engaging tools 50, relative to the machine 10, at the worksite 13 may be used to determine if said one or more ground engaging-tools 50 is connected or disengaged from the bucket 30. The system 100 is depicted schematically in FIG. 5 and some elements thereof are additionally illustrated in FIGS. 1-4.

The system 100 may include a sensor 102, which is coupled to one of the ground-engaging tools 50 and configured to transmit an identifying wireless signal 104 that is identifying of the ground-engaging tool 50, to which it is coupled. Accordingly, the identifying wireless signal 104 is recognizable to other elements of the system 100 as being associated with the ground-engaging tool 50, with which it is associated, and the identifying wireless signal 104 has an initial transmission power, which is the power of the identifying wireless signal 104 upon transmission by the sensor 102. In the present example and as illustrated in FIGS. 1-4, the sensor 102 is associated with, and determines presence of, the tooth 52. For example, as depicted in FIG. 4, the sensor 102 may be affixed inside the inner cavity 60 of the tooth 52. However, the example embodiment is merely exemplary and the system 100 may be configured to utilize the sensor 102, and/or any other sensor(s), to monitor presence of any ground-engaging tools 50 associated with the bucket 30, such as, but not limited to, additional teeth 52, the tooth adapters 54, the lip shrouds 56, the wing shrouds 58, or any other ground-engaging tools or wear parts that may be used in conjunction with the bucket 30 or any other implement 12.

The sensor 102 may be any sensor capable of transmitting wireless signals that are identifiable as transmitted from the sensor 102 and receivable by a wireless signal receiver. For example, the sensor 102 may be any sensor capable of transmitting a Bluetooth signal, a radio frequency (RF) signal, a Wi-Fi signal, or any other wireless propagating signal having a defined power upon transmission. For example, the sensor 102 may be a Bluetooth low energy (BLE) tag that transmits a low energy, wireless signal about a given range, the low energy, wireless signal being receivable by a receiver configured to detect such low energy signals.

For detecting and receiving wireless signals transmitted by the sensor 102, the system 100 may include one or more signal receivers, such as a first signal receiver 106, a second signal receiver 108, a third signal receiver 110, and any additional signal receivers, up to an nth signal receiver 112. One or more of the signal receivers 106, 108, 110, 112 may be positioned at a location proximate to the machine 10. In the non-limiting example of FIG. 1, the first signal receiver 106 is located proximate to the housing 14 of the machine 10. Example placements and configurations of signal receivers 106, 108, 110 will be discussed in more detail in conjunction with the example embodiments of FIGS. 6-8 and the corresponding detailed descriptions below. In the non-limiting example wherein the sensor 102 is a BLE tag, the signal receivers 106, 108, 110, 112 may be a "client" associated with the sensor 102, which acts as a "server" in accordance with the application programing interface software associated with BLE tag technology, known in the art. However, as mentioned above, because the sensor 102 may be configured to transmit any wireless signal carrying identifying information and having a recognizable power level, the corresponding signal receivers 106, 108, 110, 112 may be any receivers configured to receive said wireless signal carrying identifying information and having a recognizable power level.

To utilize the wireless signals transmitted by the sensor 102 and received by the signal receivers 106, 108, 110, 112, the system 100 may further include a controller 120, which includes, at least, a processor 122. The controller 120 may be any electronic controller or computing system including a processor which operates to perform operations, execute control algorithms, store data, retrieve data, gather data, and/or any other computing or monitoring task desired. The controller 120 may be a single controller or may include more than one controller disposed to interact with one or more of the sensor 102, the signal receivers 106, 108, 110, 112, and, optionally, an output device 124. Functionality of the controller 120 may be implemented in hardware and/or software and may rely on one or more data maps. To that end, the controller 120 may include internal memory 126 and/or the controller 120 may be otherwise connected to external memory 128, such as a database or server. The internal memory 126 and/or external memory 128 may include, but are not limited to including, one or more of read only memory (ROM), random access memory (RAM), a portable memory, and the like. Such memory media are examples of nontransitory memory media.

Figure 6:
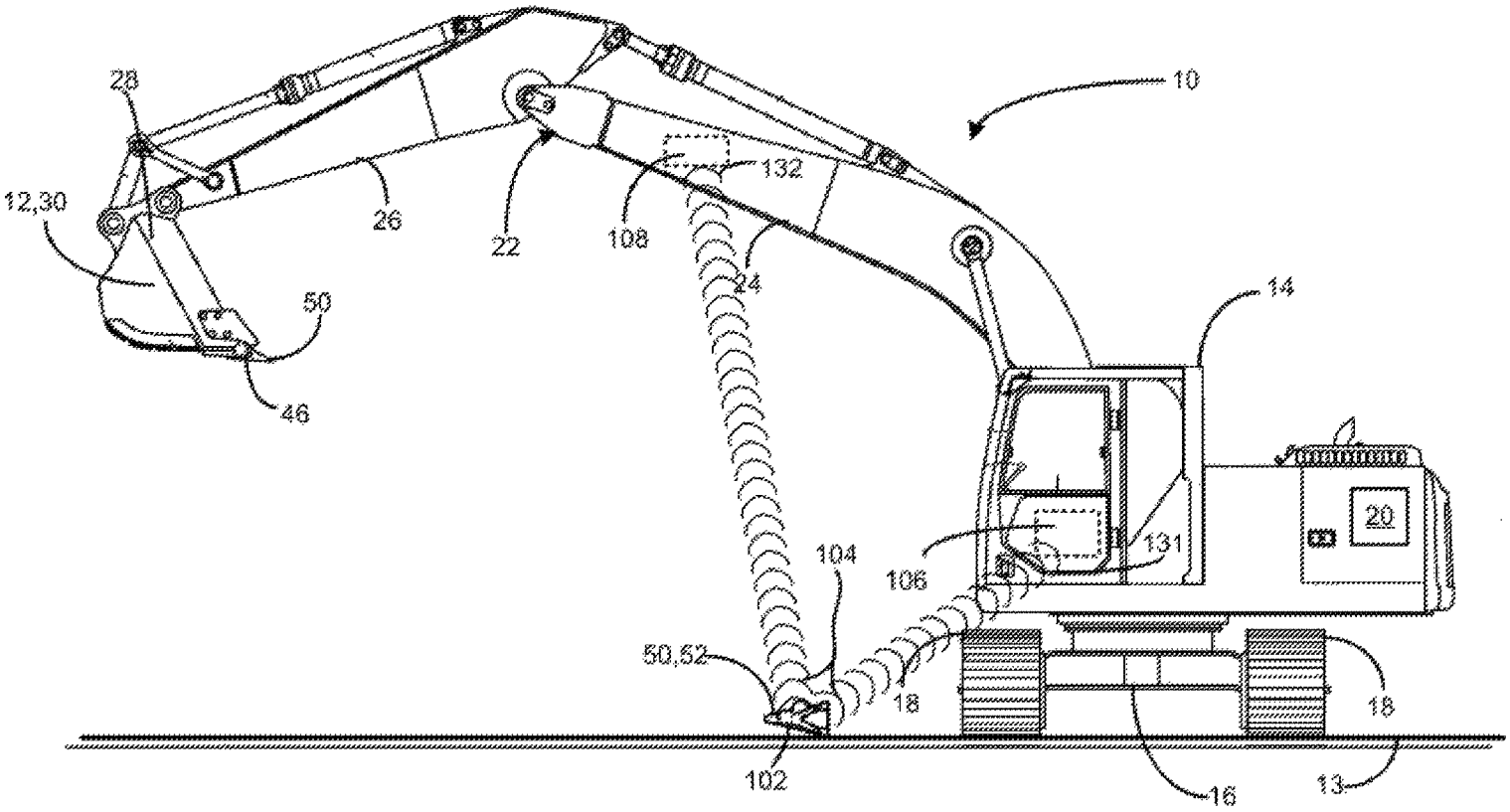
FIG. 6 is a side view of the example machine and elements of the example system for monitoring presence of one or more ground-engaging tools of FIGS. 1-5, in which a ground-engaging tool is disengaged from the implement and lies on the worksite, in accordance with an embodiment of the present disclosure.
Figure 7:
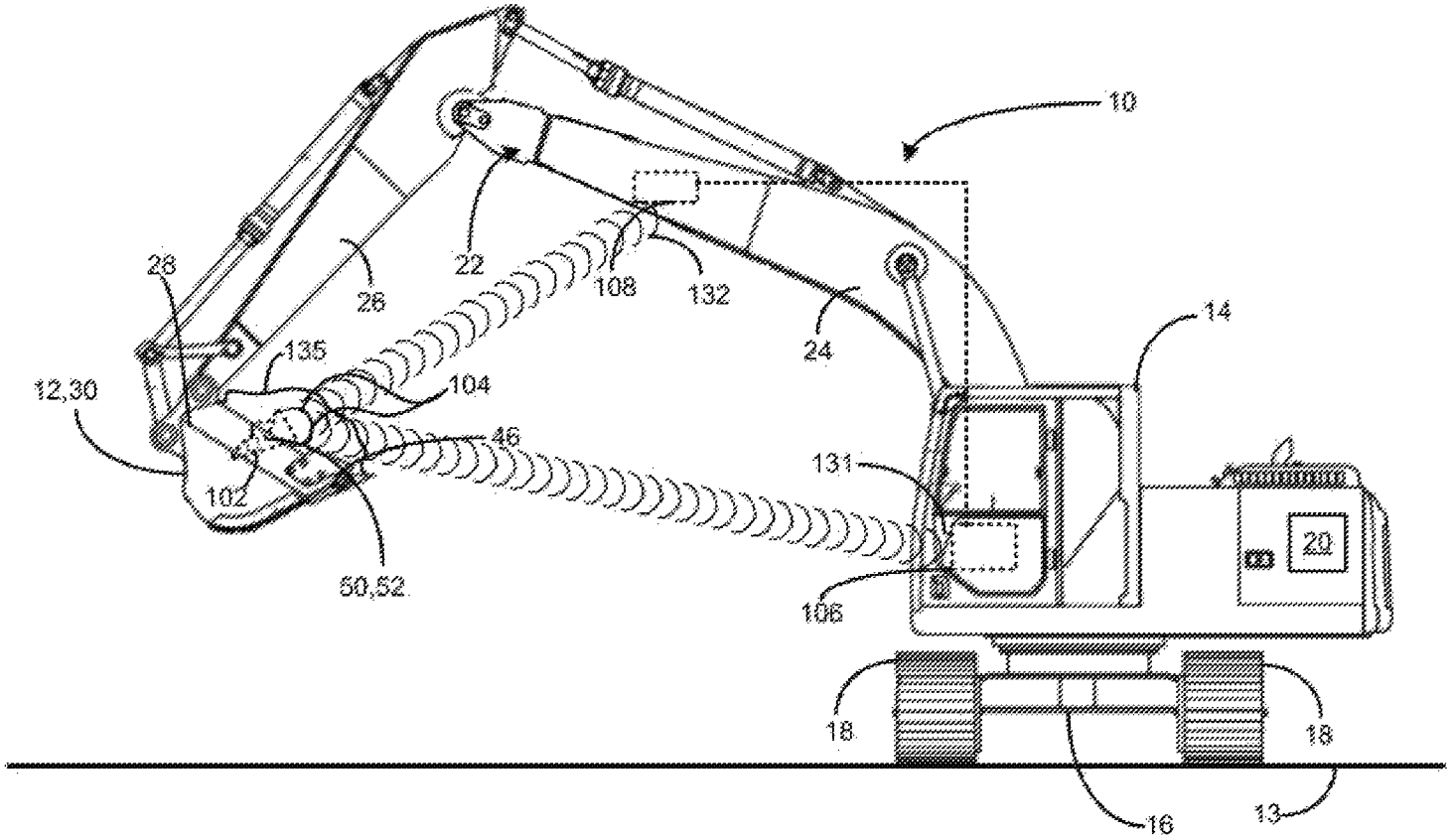
FIG. 7 is a side view of the example machine and elements of the example system for monitoring presence of one or more ground-engaging tools of FIGS. 1-5, in which a ground-engaging tool is disengaged from the implement and lies within a load hauled by the implement, in accordance with an embodiment of the present disclosure.
Figure 8:
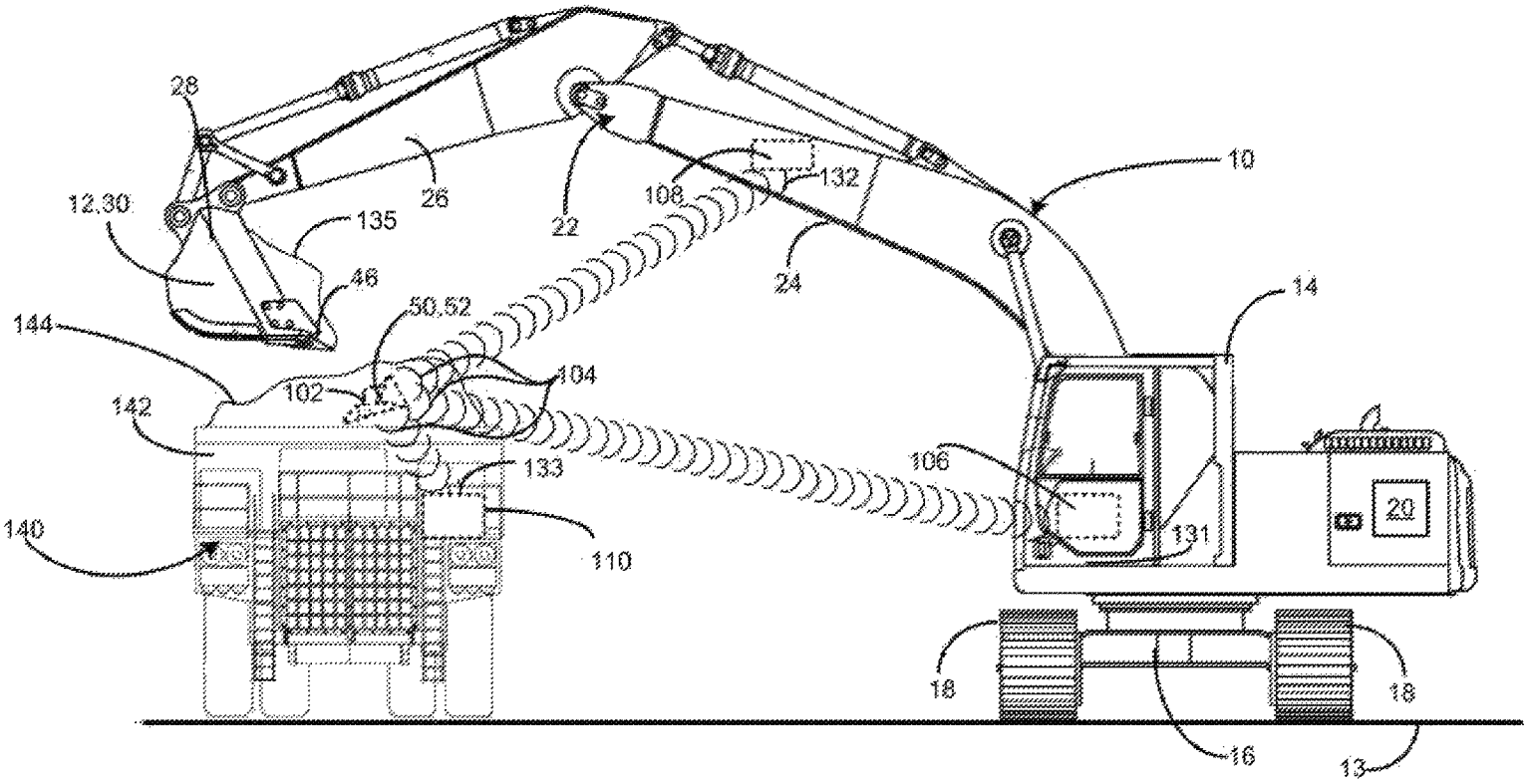
FIG. 8 is a side view of the example machine of FIG. 1, a second example machine, and elements of the example system for monitoring presence of one or more ground-engaging tools of FIGS. 1-5, in which a ground-engaging tool is disengaged from the implement and lies proximate to the second machine, in accordance with an embodiment of the present disclosure.

The controller 120 may be configured to execute instructions which, when executed, monitor presence of one of the ground-engaging devices 50, relative to the machine 10, on the worksite 13. As shown in the example embodiments that illustrate presence monitoring scenarios in FIGS. 6-8, the system 100 may monitor presence of one of the teeth 52; however, it is to be appreciated that the illustrated presence monitoring scenarios of FIGS. 6-8 are also applicable to monitoring the presence of any of the ground-engaging devices 50 discussed above and/or for monitoring the presence of any other ground-engaging devices or wear parts known in the art.

Accordingly, the controller 120 may be configured to receive a first received signal 131 from the first signal receiver 106. The first received signal may have similar signal characteristics as the identifying wireless signal 104; however, the first received signal 131 will have a different power than the transmission power of the identifying wireless signal 104, because wireless signals attenuate, albeit sometimes only in minor magnitudes of attenuation, as they propagate through an environment. As the first received signal 131 is based on the identifying wireless signal 104, it too is recognizable as being associated with the ground-engaging tool 50, to which the sensor 102 and, in turn, the identifying wireless signal 104 are coupled. While the first received signal 131 will carry the same identifying information as the identifying wireless signal 104, the signal will have a first signal power, which is generally less than the transmission power due to attenuation during signal flight within the propagating environment.

The controller 120 may be further configured to determine a first signal attenuation power based on the first signal power of the first received signal 131, relative to the transmission power of the identifying wireless signal 104. As mentioned above, the first received signal 131 may be an attenuated version of the identifying wireless signal 104 and, therefore, the first signal power may be less than the transmission power. In some examples, the controller 120 may determine the first signal attenuation power by taking a difference of the transmission power and the first signal power. The first signal attenuation power may be indicative of one or more of the following conditions: distance between the sensor 102 and the first signal receiver 106, signal pass-thru of objects and/or obstacles between the sensor 102 and the first signal receiver 106, environmental conditions within the signal propagation environment, and/or any other conditions existing within the worksite 13.

By utilizing, at least, the first signal attenuation power, the controller 120 may determine a relative location of the tooth 52 based on the first signal attenuation power. The first signal attenuation power may be indicative of the distance between the sensor 102 and the first signal receiver 106. Because the sensor 102 is affixed to or otherwise associated with the tooth 52 and the first signal receiver 106 is located proximate to the machine 10, the relative location of the tooth 52 may be indicative of a distance between the tooth 52 and the machine 10. However, other locational data derived from the first signal attenuation power may also be included with the relative location, such as relative angular locations, elevation location, location changes over time, and the like.

Further, the first signal attenuation power may be used by the controller 120 to determine if one or more fault conditions associated with the tooth 52 exist. A "fault condition," as defined herein, is any condition which may alter a relative location determination based on signal attenuation. Accordingly, fault conditions may include the existence of barriers between the sensor 102 and the first signal receiver 106 which may alter the signal power of the first received signal 131. For example, if the tooth 52 is disengaged and has fallen into a pile of materials, the materials surrounding the tooth 52 and, by association, the sensor 102 may alter the signal power of the first received signal 131; such alterations to the signal power may be indicative of the fault condition of being surrounded by materials. Additionally, fault conditions may be indicative of signal faults, such as if a received wireless signal is reflected from a reflective surface on the worksite 13. While the above examples illustrate examples of fault conditions, the system 100 is certainly not limited to detecting said example fault conditions and the fault conditions detected may include any barriers between the sensor 102 and the first signal receiver 106 which may alter the signal power of the first received signal 131. Accordingly, additional examples of fault conditions will be described below, with reference to FIGS. 6-8.

In some examples, one or both of the relative location and the existence of one or more fault conditions may be determined by the controller 120 by comparing the first signal attenuation power with existing signal attenuation data accessed by the controller 120. Such data may be stored on one or both of the internal memory 126 and the external memory 128. In some examples, the signal attenuation data may be based on experimental results. For example, the signal attenuation data may include data tables correlating signal attenuation levels with distances, which may be configured by testing signal attenuation when the sensor 102 is different distances from the first signal receiver 106. Similarly, in some examples, the signal attenuation data may include data tables correlating various fault conditions with corresponding signal attenuation levels and/or rates of change in signal attenuation. The signal attenuation data may be any look-up tables, data tables, and/or memory stores, which may be used to determine one or both of the relative location of the tooth 52 and existence of one or more of the fault conditions associated with the tooth 52. Accordingly, such look-up tables, data tables, and/or memory stores may be used to determine materials-based fault conditions (e.g., a ground-engaging tool fallen into and lying amongst a load of materials) by including information relating signal attenuation to material properties.

Based on the relative location of the tooth 52 and the determined existence, or lack thereof, of one or more fault conditions, the controller 120 may determine if the tooth 52 is connected to the bucket 30 and, in turn, connected to the machine 10. In some examples, the controller 120 may further transmit an output signal to the output device 124, the output signal instructing the output device 124 to output an alert to the operator, if the controller 120 has determined that the tooth 52 is not connected to bucket 30 and/or the machine 10. The output device 124 may be any visual, audio, or tactile output device suitable for presenting an alert to an operator or monitoring party associated with the machine 10. By determining if the tooth 52 is connected to the machine 10, the system 100 may prevent productivity loss for the machine 10 and/or the system 100 may be beneficial in preventing loss of productivity and/or damage to other machines at the worksite 13.

To illustrate practical, example implementations of the system 100, example monitoring scenarios involving, at least, the machine 10 and the associated tooth 52 are illustrated in FIGS. 6-8. While various wireless signals (e.g., the identifying wireless signal 104) are depicted in FIGS. 6-8 as being directed towards one or more signal receivers 106, 108, 110, it should not be implied that wireless signals transmitted by the sensor 102 are directional in nature; rather, the signal depictions are included to illustrate wireless signal paths between the sensor 102 and one or more signal receivers 106, 108, 110. In some examples, the wireless signals transmitted by the sensor 102 may be omnidirectional and, therefore, transmit substantially equally in all directions.

Beginning with FIG. 6, elements of the system 100 are shown implemented in conjunction with the machine 10, to monitor presence of the tooth 52. In the present example of FIG. 6, the tooth 52 may be disengaged from the bucket 30 and lies on the worksite 13. The system 100 may utilize the first signal receiver 106, which is located at a first location (e.g., proximate to the housing 14 of the machine 10) and the second signal receiver 108, which is located at a second position (e.g., proximate to the crane 22). In such examples, the controller 120 may receive a second received signal 132 from the second signal receiver 108, wherein the second received signal 132 is similarly based on the identifying wireless signal 104 and, therefore, recognizable as being associated with the tooth 52. While the second received signal 132 will carry the same identifying information as the identifying wireless signal 104, the second received signal 132 will have a second signal power, which is generally less than the transmission power due to attenuation during signal flight within the propagating environment. Similar to the determination of the first signal attenuation power, as discussed above, the controller 120 may use the second signal power to determine a second signal attenuation power for the second received signal 132 based on the second signal attenuation power, relative to the transmission power.

In such examples, the controller 120 may utilize both the first signal attenuation power and the second signal attenuation power when determining the relative location of the tooth 52, which is a location relative to the machine 10. As the controller 120 may receive or have stored information relating to the first and second locations of the first and second signal receivers 106, 108, the signal attenuation powers may, therefore, be indicative of the distances of the tooth 52 from said first and second locations. For example, determining the relative location of the tooth 52 by the controller 120 may be based on a comparison of the first signal attenuation power and the second signal attenuation power. By comparing the first and second signal attenuation powers, the determination and/or estimation of the relative distance may provide additional information relevant to determining presence of the tooth 52.

Further, in the example depicted in FIG. 6, determining existence of one or more fault conditions, by the controller 120, may be based on both the first signal attenuation power and the second signal attenuation power. For example, determining existence of one or more fault conditions associated with the tooth 52 may be based on a comparison of the first signal attenuation power with the second signal attenuation power. In such examples, an example fault condition may be a false positive reading of presence based on positional location of the tooth 52, relative to the machine 10. If the first signal receiver 106 receives a strong wireless signal from the sensor 102, then the first signal attenuation power may be low, indicating that the tooth 52 is within range and may be connected to the machine 10. However, if the second signal receiver 108 receives a weaker wireless signal and, in turn, a high second signal attenuation power, while the first signal receiver 106 receives the stronger signal, then the controller 120 may determine an example fault condition, which is that the first signal attenuation power's strength is not indicative of presence, but indicative of fault as the tooth 52 lies on the ground. Of course, other fault conditions are certainly detectable using said information.

To illustrate detection of a different fault condition that may be present when monitoring presence of the tooth 52 by the system 100, FIG. 7 depicts the machine 10 hauling a load 135 by utilizing the implement 12 (e.g., the bucket 30). When the tooth 52 becomes disengaged from the bucket 30, it may fall into materials on the worksite 13 and/or within the bucket 30. Accordingly, the tooth 52 may be accidentally picked up by or otherwise handled by the bucket 30, leading the tooth 52 to be either within, atop, below, or otherwise proximate to a load 135 hauled by the bucket 30. As shown, the tooth 52, in FIG. 7, has been buried within materials within the bucket 30. In such examples, the relative location of the tooth 52 may indicate that the tooth 52 is attached to the bucket 30. However, the first or second signal attenuation powers may be analyzed by the controller 120 and attenuation and/or attenuation patterns analyzed may indicate that the tooth 52 is within, atop, below, or otherwise proximate to the load 135 hauled by the bucket 30, as the materials of the load 135 may act as a barrier to the signal which may weaken the signal's power. Accordingly, determining existence of one or more fault conditions associated with the tooth 52, based on one or both of the first and second signal attenuation powers, may include determining if the ground-engaging tool 50 is within the load 135.

In some examples, such as the example illustration in FIG. 7, the first and second receivers 106, 108 may be in operative communication during functions of the system 100. Accordingly, the first and second receivers 106, 108 may be communicatively coupled via any wired or wireless method of communication. In such examples, the wireless signal 131 may be out of range of the first receiver 106 and, via the communicative coupling, the second receiver 108 may transmit the second received signal 132, and/or any characteristics thereof, to the first receiver 106. Accordingly, data related to the second received signal 132 may then be used by other elements of the system 100, via receipt by the first receiver 106.

FIG. 8 illustrates a scenario in which the machine 10 operates on the worksite 13 in conjunction with a second machine 140. While the second machine 140 is depicted in FIG. 8 as a truck, the second machine 140 may be any machine operating in conjunction with the machine 10. Accordingly, when the second machine 140 is present on the worksite 13, controller 120 may further be configured to determine proximity of the tooth 52 to the second machine 140 based on, at least, one or both of the relative location of the tooth 52, the existence of one or more fault conditions, and combinations thereof.

In some such examples, the third signal receiver 110 may be located at a third location, which is proximate to the second machine 140. In such examples, the controller 120 may be configured to receive a third received signal 133 from the third signal receiver 110, wherein the third received signal 133 is based on the identifying wireless signal 104 and, therefore, is recognizable as being associated with the tooth 52. The third received signal may have a third signal power and the controller 120 may determine a third signal attenuation power of the third received signal 133 based on the third signal attenuation power relative to the transmission power of the identifying wireless signal 104. In such examples, determining the relative location of the tooth 52, by the controller 120, may be based on one or more of the first, second, and/or third signal attenuation powers and determining existence of one or more fault conditions associated with the tooth 52 may be based on one or more of the first, second, and/or third signal attenuation powers. Further, proximity of the tooth 52 to the second machine 140 may be based on the third signal attenuation power and one or more of the relative location of the tooth 52, the existence of the one or more fault conditions, and combinations thereof.

In some examples, such as the illustration of FIG. 8, the second machine 140 includes a bed 142 which may be configured to carry a bed load 144. The bed load 144 may include materials from the worksite 13 and/or materials hauled to the bed load 144 by the machine 10 (e.g., from the load 135 associated with the bucket 30). In scenarios in which the tooth 52 becomes disengaged from the bucket 30, it may fall into materials on the worksite 13, within the bucket 30, and/or into the bed load 144. Accordingly, the tooth 52 may be located proximate to the bed load 144, leading the tooth 52 to be either within, atop, below, or otherwise proximate to the bed load 144. In such examples, determining existence of one or more fault conditions associated with the tooth 52, based on one or more of the first, second, and third signal attenuation powers, may include determining if the ground-engaging tool 50 is within the bed load 144. The first, second, and/or third attenuation powers may be analyzed by the controller 120 and attenuation and/or attenuation patters therein may indicate that the tooth 52 is within, atop, below, or otherwise proximate to the bed load 144 of the second machine 140, as the materials of the bed load 144 may act as a barrier to the signal, which may weaken the signal's power.

While the example illustrated scenarios of FIGS. 6-8 show example worksites, the system 100 is certainly not limited to use on only the example worksites and the elements contained therein (e.g., the machine 10, the second machine 140). The system 100 may be used in conjunction with any machines and/or positions on a worksite, in which ground-engaging tool monitoring is desired. For example, additional receivers, up to the nth receiver 112, may be positioned proximate to other downstream actors in a working operation and communicate with the controller 120. In the material moving operations illustrated herein, additional receivers 112 may be positioned on downstream material receiver and/or processing elements known in the art, such as, but not limited to, material conveyors, crushers, and the like, and communicate information associated with the tooth 52 to the controller 120.

INDUSTRIAL APPLICABILITY

In general, the foregoing disclosure finds utility in various industries, employing machines, in which presence monitoring systems for machine components and, more particularly, presence monitoring systems configured to determine presence of a ground-engaging tool or wear part are desirable. Maintaining knowledge of presence of ground-engaging tools, relative to a machine, is useful in improving productivity of the machine and, in general, a working operation at a worksite. If a ground-engaging tool is disengaged from the machine, it could hinder the quality and/or efficiency of operation of said machine. Furthermore, disengaged ground-engaging tools may become mixed within materials and/or may lie in movement paths of the machine and/or other machines in the worksite. In such scenarios, the disengaged ground-engaging tool may adversely affect productivity and/or functions of the machine and/or other, downstream machines on the worksite. For example, if materials are hauled to a crusher on the worksite and the hauled materials include a disengaged ground-engaging tool, then the ground-engaging tool may be entered into the crusher with the materials. When a foreign object, such as a disengaged ground-engaging tool, enters a machine it is not intended to enter, like the crusher, it may damage or slow operations of said machine, which the foreign object has entered.

Figure 9:
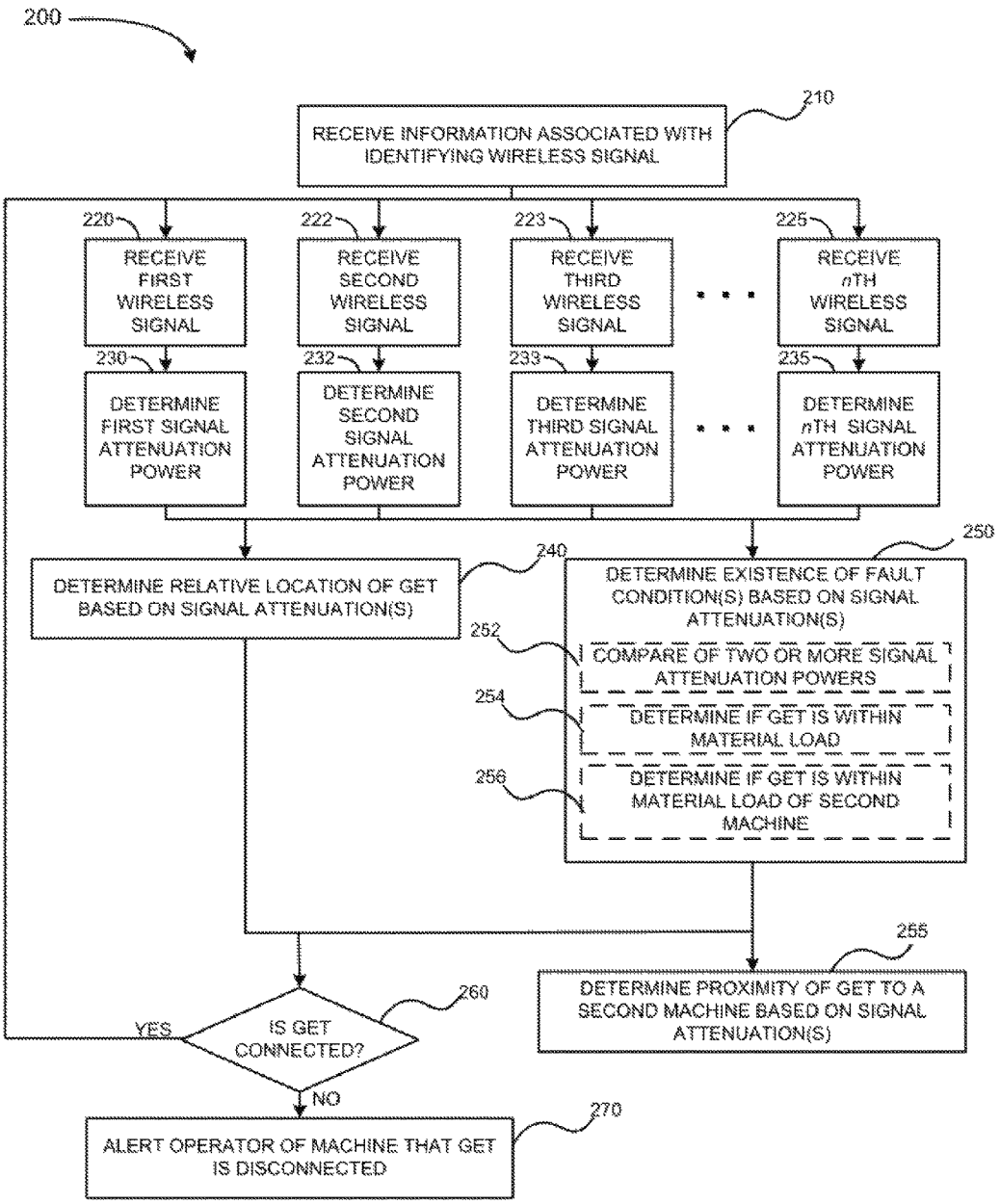
FIG. 9 is an example flowchart illustrating a method for monitoring presence of a ground-engaging tool relative to a machine on a worksite, in accordance with an embodiment of the present disclosure.

In order to prevent such potential productivity loses and/or equipment issues, the system 100 for monitoring presence of ground-engaging tools, discussed above, may be employed. The system 100 may be utilized in addition to or in conjunction with a method 200 for monitoring positioning of a ground-engaging tool 50 relative to a machine on a worksite, which is exemplified by the flowchart of FIG. 9. While the description of the method 200 presented below references elements of the system 100, the method 200 may be executed using alternative elements and should not be construed as limited to execution via the system 100 and/or components thereof. As depicted in FIG. 9, the term "ground-engaging tool" is abbreviated in an acronym form, as "GET."

The method 200 begins at block 210, wherein information associated with the identifying wireless signal 104 is received by, for example, the controller 120. The identifying wireless signal 104 is transmitted by the sensor 102, which, as detailed above, is operatively coupled to a ground-engaging tool 50 such as, but not limited to, the tooth 52. The identifying wireless signal 104 is recognizable by, for example, one of the signal receivers 106, 108, 110, 112 as being associated with the ground-engaging tool 50 with which the sensor 102 is coupled. Further, the information associated with the identifying wireless signal 104 includes a transmission power for the identifying wireless signal 104.

The method 200 may include one or more steps related to receiving wireless signals that are based upon the transmitted, identifying wireless signal 104 from the sensor 102. For example, the method 200 may include receiving the first received signal 131 at the first location (e.g., proximate to the housing 14 of the machine 10), as shown in block 220. The first received signal is based on the identifying wireless signal 104, recognizable as being associated with the ground-engaging tool 50, and having a first signal power. In some examples, the method 200 may include receiving the second received signal 132 at the second location (e.g., proximate to the crane 22 of the machine 10), as shown in block 222. The second received signal 132 is based on the identifying wireless signal 104, recognizable as being associated with the ground-engaging tool 50, and having a second signal power. Further, in some examples, the method 200 may include receiving the third received signal 133 at the third location (e.g., proximate to the second machine 140), as shown in block 223. The third received signal 133 is based on the identifying wireless signal 104, recognizable as being associated with the ground-engaging tool 50, and having a third signal power. In some examples, the first, second, and third received signals 131, 132, 133 may each be received, respectively, by the first, second, and third signal receivers 106, 108, 110. Further, any number of received signals may be received from the sensor 102 during execution of the method 200. Accordingly, the method 200 is depicted in FIG. 9 as including block 225, wherein an nth wireless signal is received; the nth received signal may have similar characteristics to those of the first, second and third received signals 131, 132, 133.

Based on the first received signal 131 from block 220 relative to the transmission power, the method 200 may determine a first signal attenuation power of the first received signal 131, as shown in block 230. In some examples, the method 200 may include determining a second signal attenuation power of the second received signal 132 of block 222, based on the second received signal 132 relative to the transmission power, as depicted in block 232. Additionally or alternatively, some other examples may include block 233, wherein the method 200 may include determining a third signal attenuation power of the third received signal 133 of block 223, based on the third received signal 133 relative to the transmission power. As discussed above, the method 200 may receive n wireless signals; therefore, as depicted in block 235, the method 200 may be configured to determine n signal attenuation powers based on n received wireless signals.

By utilizing one or more of the first, second, and third signal attenuation powers, the method 200 may determine a relative location of the ground-engaging tool 50, which is a location relative to the machine 10, as shown in block 240. In some examples, determining the relative location of the ground-engaging tool 50 includes making a comparison of, for example, the first signal attenuation power and the second signal attenuation power, wherein the first signal attenuation power is indicative of distance between the sensor 102 and the first location and the second signal attenuation power is indicative of distance between the sensor 102 and the second location. Of course, a comparison of any of the first, second, third, and nth signal attenuation powers may be used in determining relative location of the ground-engaging tool 50.

Additionally, the method 200 may include determining existence of one or more fault conditions, associated with the ground-engaging tool 50, based on one or more of the first, second, third, and nth signal attenuation powers, as shown in block 250. As discussed above, a fault condition may any condition which may alter a relative location determination based on signal attenuation. Block 250 includes sub-blocks 252, 254, and 256, each describing an example fault condition which may be determined at block 250 by the method 200. For example, determining existence of one or more fault conditions may be based on a comparison of the two or more of the first, second, third, and nth signal attenuation powers, as depicted in sub-block 252. Further, in some examples wherein the implement 12 is configured to haul the load 135, determining existence of one or more fault conditions associated with the ground-engaging tool 50 based on one or more of the first, second, third, and nth signal attenuation powers includes determining, based on said one or more signal attenuation powers, if the ground-engaging tool 50 is within the load 135, as depicted in sub-block 254. Additionally, in some examples wherein the second machine 140 is on the worksite 13 and includes the bed 142 hauling the bed load 144, determining existence of one or more fault conditions associated with the ground-engaging tool 50 includes determining if the ground-engaging tool 50 is within the bed load 144, based on one or more of the first, second, third, and nth signal attenuation powers, as depicted in sub-block 256.

In some examples wherein the second machine 140 exists on the worksite 13, the method 200 may further include determining proximity of the ground-engaging tool 50 to the second machine 140 based on, at least, one or both of the relative location of the ground-engaging tool 50, the existence of one or more faults, and any combinations thereof, as depicted in block 255. The proximity of the ground-engaging tool 50, in some examples, may be useful in determining if the ground-engaging tool 50 is connected to the machine 10.

By utilizing the relative location of the ground-engaging tool 50 and the knowledge of existence of the one or more faults, the method 200 may determine if the ground-engaging tool 50 is connected to the machine 10, as depicted in the decision block 260. In some examples, if the ground-engaging tool 50 is determined to not be connected to the machine 10, the method 200 may further include alerting the operator that the ground-engaging tool 50 is not connected via, for example, the output device 124, as depicted in block 270. Otherwise, the method 200 may return to blocks 220, 222, 223, 225 to continue presence monitoring operations. By utilizing the method 200, productivity loss and/or equipment damage caused by disengaged ground-engaging tools 50 may be prevented.

It will be appreciated that the present disclosure provides control systems for implements of machines, which utilize orientation leveling systems. While only certain embodiments have been set forth, alternatives and modifications will be apparent from the above description to those skilled in the art. These and other alternatives are considered equivalents and within the spirit and scope of this disclosure and the appended claims.

What is claimed is:

1. A system for monitoring presence of a ground-engaging tool relative to a machine on a worksite, the system comprising:

a sensor operatively coupled to the ground-engaging tool and configured to transmit an identifying wireless signal, the identifying wireless signal recognizable as being associated with the ground-engaging tool and having a transmission power upon transmission;

a first signal receiver at a first location configured to detect and receive wireless signals from the sensor;

a second signal receiver at a second location configured to receive wireless signals from the sensor;

a controller, including a processor, operatively associated with the first and second signal receivers and configured to:

receive a first received signal from the first signal receiver, the first received signal based on the identifying wireless signal, recognizable as being associated with the ground-engaging tool, and having a first signal power;

receive a second received signal from the second signal receiver, the second received signal based on the identifying wireless signal, recognizable as being associated with the ground-engaging tool, and having a second signal power;

determine a first signal attenuation power of the first received signal based on the first signal power relative to the transmission power;

determine a second signal attenuation power of the second received signal based on the second signal power relative to the transmission power;

determine a relative location of the ground-engaging tool, relative to the machine, based on the first and second signal attenuation powers;

determine existence of one or more fault conditions associated with the ground engaging tool based on the first and second signal attenuation powers; and determine if the ground-engaging tool is connected to the machine based on the relative location of the ground-engaging tool and the existence of one or more fault conditions;

wherein determining the relative location of the ground-engaging tool, relative to the machine, by the controller is based on a comparison of the first signal attenuation power and the second signal attenuation power, wherein the first signal attenuation power is indicative of distance between the sensor and the first location and the second signal attenuation power is indicative of distance between the sensor and the second location.

2. The system of claim 1, further comprising an output device configured to output an alert to an operator of the machine based on input from the controller and wherein the controller is further configured to transmit an output signal to the output device, instructing the output device to output the alert to the operator, if the controller determines that the ground-engaging tool is not connected to the machine.

3. The system of claim 1, wherein the first signal receiver is at a first location proximate to the machine and the second signal receiver is at a second location proximate to the machine.

4. The system of claim 3, wherein the machine includes a body, a crane, and an implement operatively associated with the crane and the ground-engaging tool is configured for connectivity with the implement, and wherein the first location for the first receiver is proximate to the body and the second location for the second receiver is proximate to the crane.

5. The system of claim 1, wherein determining existence of one or more fault conditions associated with the ground-engaging tool is based on a comparison of the first signal attenuation power with the second signal attenuation power.

6. The system of claim 1, wherein the machine includes an implement configured to haul a load and determining existence of one or more fault conditions associated with the ground-engaging tool based on the first signal attenuation power includes determining, based on the first signal attenuation power, if the ground-engaging tool is within the load.

7. The system of claim 1, wherein a second machine is present on the worksite and the controller is further configured to determine proximity of the ground-engaging tool to the second machine based on, at least, one or more of the relative location of the ground-engaging tool, the existence of one or more fault conditions, and combinations thereof.

8. The system of claim 7, further comprising a third signal receiver at a third location proximate to the second machine and configured to receive the wireless signal from the sensor and wherein the controller is further configured to:

receive a third received signal from the third signal receiver, the third received signal based on the identifying wireless signal, recognizable as being associated with the ground-engaging tool, and having a third signal power; and determine a third signal attenuation power of the third received signal based on the third signal attenuation power relative to the transmission power; and wherein determining the relative location of the ground-engaging tool, relative to the machine, by the controller, is based on one or both of the first signal attenuation power and the third signal attenuation power, wherein determining existence of one or more fault conditions associated with the ground-engaging tool, by the controller, is based on the first signal attenuation power and the third signal attenuation power, and wherein determining, by the controller, proximity of the ground-engaging tool to the second machine is based on the third signal attenuation power and, at least, one or more of the relative location of the ground-engaging tool, the existence of one or more fault conditions, and combinations thereof.

9. The system of claim 8, wherein the second machine includes a bed configured to haul a load and determining existence of one or more fault conditions associated with the ground-engaging tool, by the controller, includes determining if the ground-engaging tool is within the load based on one or both of the first signal attenuation power, the third signal attenuation power, and combinations thereof.

10. The system of claim 1, wherein the ground-engaging tool is one or more of a tooth, an adapter, a lip shroud, a wing shroud, a blade segment, and any combinations thereof.

11. A method for monitoring positioning of a ground-engaging tool relative to a machine on a worksite, the method comprising:

receiving information associated with an identifying wireless signal, the identifying wireless signal transmitted by a sensor operatively coupled to the ground-engaging tool and recognizable as being associated with the ground-engaging tool, the information associated with the identifying wireless signal including a transmission power of the identifying wireless signal;

receiving a first received signal at a first location, the first received signal based on the identifying wireless signal, recognizable as being associated with the ground-engaging tool, and having a first signal power;

receiving a second received signal at a second location, the second received signal based on the identifying wireless signal, recognizable as being associated with the ground-engaging tool, and having a second signal power;

determining a first signal attenuation power of the first received signal based on the first signal power relative to the transmission power;

determining a second signal attenuation power of the second received signal based on the second signal power relative to the transmission power;

determining a relative location of the ground-engaging tool, relative to the machine, based on the first and second signal attenuation powers;

determining existence of one or more fault conditions associated with the ground-engaging tool, based on the first and second signal attenuation powers; and determining if the ground-engaging tool is connected to the machine based on the relative location of the ground-engaging tool and the existence of one or more fault conditions;

wherein determining the relative location of the ground-engaging tool, relative to the machine, is based on a comparison of the first signal attenuation power and the second signal attenuation power, wherein the first signal attenuation power is indicative of distance between the sensor and the first location and the second signal attenuation power is indicative of distance between the sensor and the second location.

12. The method of claim 11, further comprising alerting an operator of the machine if it is determined that the ground-engaging tool is not connected to the machine.

13. The method of claim 11, wherein determining existence of one or more fault conditions associated with the ground-engaging tool is based on a comparison of the first signal attenuation power with the second signal attenuation power.

14. The method of claim 11, wherein the machine includes an implement configured to haul a load and determining existence of one or more fault conditions associated with the ground-engaging tool based on the first signal attenuation power includes determining, based on the first signal attenuation power, if the ground-engaging tool is within the load.

15. The method of claim 11, wherein a second machine is present on the worksite and the method further comprises determining proximity of the ground-engaging tool to the second machine based on, at least, one or both of the relative location of the ground-engaging tool, the existence of one or more of faults, and combinations thereof.

16. The method of claim 15, wherein the second machine includes a bed configured to haul a load and the method further comprises determining existence of one or more fault conditions associated with the ground-engaging tool includes determining if the ground-engaging tool is within the load based on based on the first signal attenuation power.

* * * * *